United States Patent [19]

Cook, Jr. et al.

[11] 4,090,564

[45] May 23, 1978

[54] METHOD FOR INCREASING THE RECOVERY OF OIL AND GAS FROM A WATER INVADED GEO-PRESSURED WATER DRIVE OIL RESERVOIR

[75] Inventors: Harold L. Cook, Jr.; Ernest C. Geer, both of Houston, Tex.

[73] Assignee: Transco Energy Company, Houston, Tex.

[21] Appl. No.: 806,414

[22] Filed: Jun. 14, 1977

Related U.S. Application Data

[63] Continuation-in-part of Ser. No. 689,622, May 24, 1976, Pat. No. 4,042,034, which is a continuation-in-part of Ser. No. 589,300, Jun. 23, 1975, abandoned.

[51] Int. Cl.[2] ..... E21B 43/00

[52] U.S. Cl. ..... 166/314

[58] Field of Search ..... 166/314, 268, 273–275, 166/263, 245, 252, 265, 267, 250; 175/50

[56] References Cited

U.S. PATENT DOCUMENTS

| | | | |
|---|---|---|---|
| 2,077,912 | 4/1937 | Van Voorhis | 166/265 |
| 3,090,316 | 5/1963 | Montgomery | 166/314 |
| 3,123,134 | 3/1964 | Kyte et al. | 166/263 |
| 3,134,434 | 5/1964 | Wooddy, Jr. | 166/263 |
| 3,302,581 | 2/1967 | Burch | 166/314 |
| 3,312,278 | 4/1967 | Warden | 166/274 X |
| 3,382,933 | 5/1968 | Hottman | 175/50 |
| 3,785,446 | 1/1974 | Fertl et al. | 175/50 |

OTHER PUBLICATIONS

Amyx et al., "Petroleum Reservoir Engineering, Physical Properties" McGraw-Hill Book Co., Inc., N.Y., N.Y., 1960, pp. 14–16.

Muskat, "Physical Principles of Oil Production," McGraw-Hill Book Co., Inc., N.Y., 1949, pp. 364–369.

Szilas, "Production and Transport of Oil and Gas," Elsevier Scientific Publishing Co., N.Y., 1975, pp. 242, 243, 252–254.

*Primary Examiner*—Stephen J. Novosad

*Attorney, Agent, or Firm*—Fulbright & Jaworski

[57] ABSTRACT

A method for the economic recovery of significant additional quantities of oil and gas from a geo-pressured water-drive oil reservoir where oil production has ceased by conventional production techniques and equipment. The method increases the recovery from this type of reservoir, after primary depletion by conventional techniques, by producing the water (and a quantity of oil) from the wells at an abnormally high rate of flow and thereby induces a significant pressure drop in the reservoir remote from the well. This will then induce a significant release of solution gas from the oil through the reservoir. Since the residual hydrocarbon saturation in a water-wet porous media is a constant value for a given reservoir rock, a part of the gas released from solution will increase the hydrocarbon saturation and allow a portion of the oil and gas to become mobile and migrate to the producing wells to be recovered.

12 Claims, 10 Drawing Figures

METHOD FOR INCREASING THE RECOVERY OF OIL AND GAS FROM A WATER INVADED GEO-PRESSURED WATER DRIVE OIL RESERVOIR

RELATED APPLICATIONS

This application is a continuation-in-part of copending application Ser. No. 689,622 filed May 24, 1976, and now U.S. Pat. No. 4,042,034, which in turn was a continuation-in-part of application Ser. No. 589,300 filed June 23, 1975, now abandoned.

BACKGROUND OF THE INVENTION

In conventional production techniques in the production of oil, the wells are operated so as to change the reservoir saturations as little as possible. That is, the wells are produced at moderate rates with minimum reservoir pressure drop in order to allow the gas in solution in the oil to be produced along with the oil so as to retain the gas energy to "lift" the oil to the surface. In doing this, a primary concern is to preclude the gas from separating from the oil in the reservoir. Gas separated from its oil in the reservoir will migrate due to its lower density (compared to oil) to a high structural location and become unavailable for lifting the oil to the surface. Separation of solution gas from its oil in the reservoir normally is minimized also for the reason that excessive gas would be produced along with oil usually resulting in a decrease in the allowable oil production by regulatory bodies. And importantly, the loss of gas from oil impedes the flow of oil to the well.

In a geo-pressured oil reservoir having a geo-pressured water drive, the unrecovered, bypassed or "residual" oil remaining in a "watered-out" reservoir, that is, where oil production ceases due to the invasion of water, will exist at essentially the original pressure of the reservoir and will contain essentially its original quantity of solution gas.

It is known that the residual hydrocarbon saturation remaining after "watering out" of an oil reservoir is some fixed fraction of the pore volume of the reservoir. The hydrocarbon occupying this fraction of the reservoir pore volume is liquid (crude oil) or gaseous (natural gas), and can exist as free oil or gas or dissolved gas. Gas will be dissolved in both the crude oil and in the water coexisting in the pore space. The crude oil is barely soluble in reservoir waters and therefore, will exist as free oil.

The coast of the United States bordering the Gulf of Mexico has numerous geo-pressured reservoirs or aquifers in which "watered-out" oil reservoirs exist.

Our prior copending application Ser. No. 689,622, now U.S. Pat. No. 4,042,034, disclosed the concept of increasing the recovery of natural gas from geo-pressured aquifers by producing water from wells at a high production rate to reduce formation pressure significantly whereby an increased amount of natural gas could be released and recovered. The amount of gas in solution with water is generally only about 30 to 50 scf per barrel of water. It is much more important to recover the hydrocarbons from a depleted oil well than a gas well as the recovery can result in a greater unit volume of energy sources because the oil is more valuable than gas, and also the amount of gas in solution with oil may be 500 scf per barrel of oil or more.

SUMMARY

The present invention is directed to a method of increasing the recovery of oil and gas from "watered-out" geo-pressured oil reservoirs which have been depleted by conventional production techniques. This will be done by providing one or more wells, completed preferentially, but not necessarily, in all zones that contain oil. The well(s) will then be produced at the maximum rate possible without damage to the sand completions, or massive errosion of the well tubing, up to about 50,000 Bbl of fluid per day per well. This rate may be exceeded, but is sufficient to cause an adequate pressure sink, for example a pressure decrease of 25%, in the area of the well bore(s) and induce dis-dissolving of the gas from the oil and/or water. Even a lower rate, for example, 25,000 Bbl per day, may adequately induce the dis-dissolving process. Any gas that might have previously existed as free gas, plus the newly dis-dissolved free gas then will be caused to expand in the sand pores as the pressure is further reduced due to the rapid production of water. The introduction of additional free gas into the pore space of the reservoir will be accompanied eventually by displacement of oil or gas or water from the space, or a combination of any two, or all three. The rate of pressure decline, and the relative permeabilities of the three fluids will establish the percentage of each that is mobile and migrates to the well bore to be produced. Only a small percentage of the initial reservoir water need be produced to effect the pressure drop required to create the conditions described. Initially, the produced fluid will consist of almost 100% water (with its dissolved gas). As the pressure in the watered-out oil reservoir decreases, the water will be accompanied by a large percentage of oil and/or gas.

Yet further objects of the present invention are: (a) to use existing or re-worked wells without requiring additional expensive new wells; (b) to reduce pressure and allow gas to dis-dissolve from crude oil, such gas then expands and becomes mobile; (c) to cause crude oil to be discharged from sand pores and become mobile; (d) to allow recovery of oil and/or gas from watered-out geo-pressured reservoirs; (e) to reduce pressure in a reservoir at such a rate as to cause the maximum pressure drop in oil/gas bearing zone and thereby to release the maximum amount of oil and gas; and (f) to create attic gas pockets in any "highs" in the reservoir or adjacent to impermeable barriers contained within the sand which gas pockets can be produced by gas wells.

Other and further features and advantages will be readily apparent from the following description of a preferred embodiment.

DESCRIPTION OF THE PREFERRED EMBODIMENT

Figure 7:
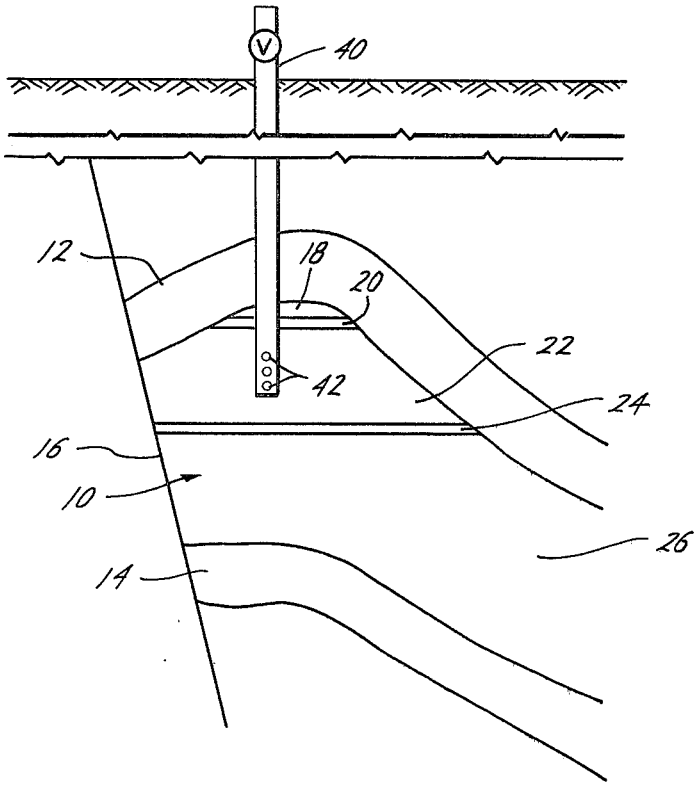
FIG. 7 is a cross-sectional view of a conventional geo-pressured oil reservoir before primary oil production, showing barriers impermeable to oil and gas showing the location of a production well, and of various water, gas, and oil-bearing zones.

Referring now to FIG. 7, a conventional type geo-pressured water drive aquifer, generally indicated by the reference numeral 10, is shown having an upper impervious formation 12, a lower impervious formation 14, a fault 16. Such an aquifer 10 may include a variety of gas, oil and water-bearing zones 18, 20, 22, 24, and 26. FIG. 7 is a cross-sectional view before primary or conventional oil production has occurred.

Figure 1:
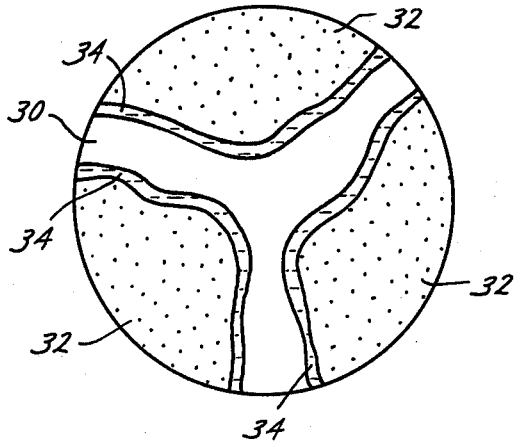
FIG. 1 is an enlarged cross-sectional view of a permeable sand body, having a continuous free-gas phase existing within the pores between water-wetted sand grains.
Figure 2:
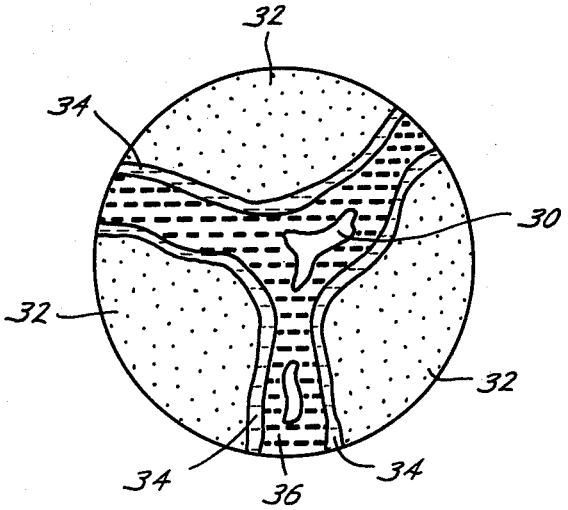
FIG. 2 is an enlarged cross-sectional view of a permeable sand body, having a continuous oil phase within the connected pores between water-wetted sand grains, free gas bubbles dispersed in the oil, and having gas in solution with the oil.

Zone 18, as best illustrated in FIG. 1, has a continuous free-gas phase 30 existing within the pores between sand grains 32 which are water wetted by having a layer of water 34 with gas in solution in the water 34. Zone 20 is illustrated in FIG. 2 and again shows sand grains 32 which are water wetted with water 34 having gas in solution in the water 34 but having a continuous oil phase 36 within the connected pores between the water wetted sand grains 32 with free gas bubbles 30 dispersed in the oil 36 and having gas in solution in the oil 36. It is to be noted that zones 18 and 20 may or may not originally exist in some water drive oil reservoirs.

Figure 3:
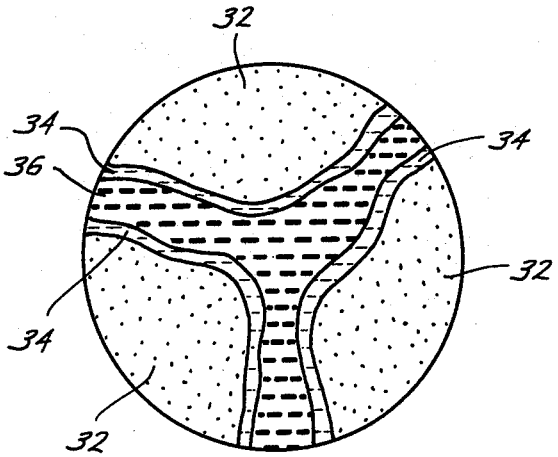
FIG. 3 is an enlarged cross-sectional view of a permeable sand body, having a continuous oil phase within the connected pores between water-wetted sand grains, and having gas in solution with the oil.
Figure 5:
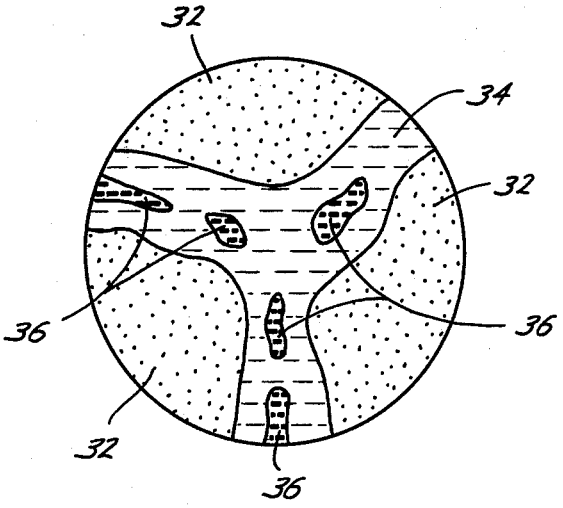
FIG. 5 is an enlarged cross-sectional view of a permeable sand body, having a continuous water phase within the connected pores and having gas in solution in oil bubbles dispersed in the water.
Figure 6:
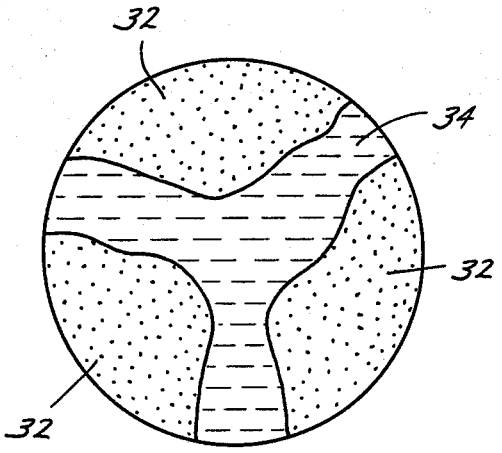
FIG. 6 is an enlarged cross-sectional view of a permeable sand body, having water-filled pores and having gas in solution with the water.

Zone 22 is illustrated in FIG. 3 and has a continuous oil phase 36 within the connected pores between the sand grains 32 which are wetted with water 34 and having gas in solution in the oil 36. Zone 24, illustrated in FIG. 5, is an interface zone between the oil-bearing sand zone 22 and the water zone 26 in which a continuous water phase 34 is in the connected pores between the sand grains 32 and in which oil bubbles 36 exist having gas in solution in the oil. Zone 26, as illustrated in FIG. 6, has water 34 filling the pores between the sand grains 32 and includes gas in solution in the water 34.

FIG. 7 illustrates the aquifer 10 in which oil is produced from the zone 22 through a conventional well 40 having openings 42 in zone 22. Conventional oil production is obtained by producing oil through the well 40 as the geo-pressure in the aquifer 10 forces the oil from zone 22 through the well 40. As the oil flows from zone 22, the water in zone 26 rises due to its pressure and continues to push the oil upward and through the well 40. As indicated, with conventional production practice, the well 40 is produced at moderate rates, typically less than 1,000 barrels of oil per day with a minimum reservoir pressure drop in order to keep the gas that is in solution with the oil 36 in zone 22 (FIG. 3) from being released from the oil 36.

Figure 4:
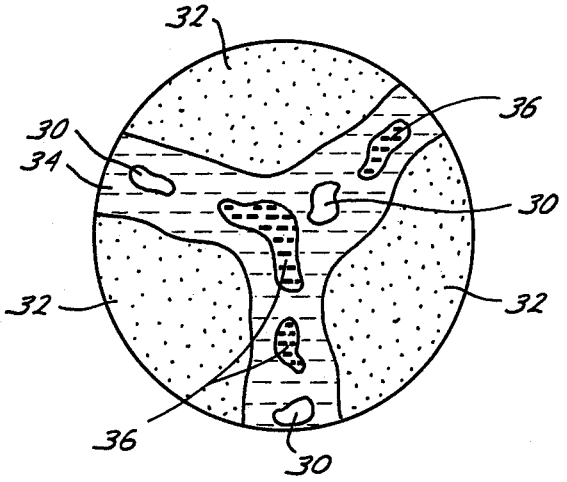
FIG. 4 is an enlarged cross-sectional view of a permeable sand body, having a continuous water phase within the pores, free oil and gas bubbles dispersed in the water-filled pores and having gas in solution with the water and gas in solution with the oil.
Figure 8:
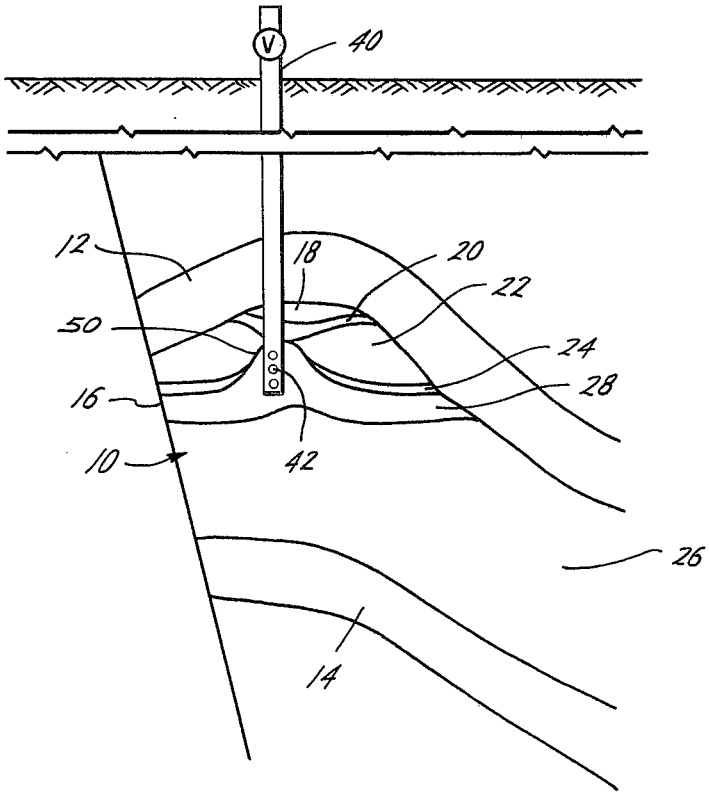
FIG. 8 is a cross-sectional view of the oil reservoir of FIG. 7 after cessation of primary oil production.

Referring now to FIG. 8, the aquifer 10 of FIG. 7 has ceased conventional oil production as the geo-pressured water drive from zone 26 flows upwardly through the interface zone 24 and oil-bearing zone 22 to the openings 42 of the well 40. Thus, the typical geo-pressured water drive reservoir has "watered out" and the water, which forms a cone 50, has displaced the oil from the sand pores adjacent to the bottom of the well 40 and has created a zone 28, as illustrated in FIG. 4, wherein a continuous water phase 34 exists between the pores of the sand grains 32 with free oil 36 and gas bubbles 30 dispersed in the water 34 and having gas in solution in water and gas in solution in the oil 36. Generally, when the well 40 waters out production ceases and the valuable hydrocarbons will remain in what is left of zone 22 of FIG. 8 which includes oil and a considerable volume of gas in solution in the oil (for example, 500 scf of gas per barrel of oil). It is also to be noted in FIG. 8 that due to a slight lowering of reservoir pressure near the well 40 during conventional oil production, the zones 18 and 20 have become slightly larger in volume, as compared to FIG. 7 which was before oil production, due to gas expansion even though producers normally attempt to minimize this effect.

Figure 9:
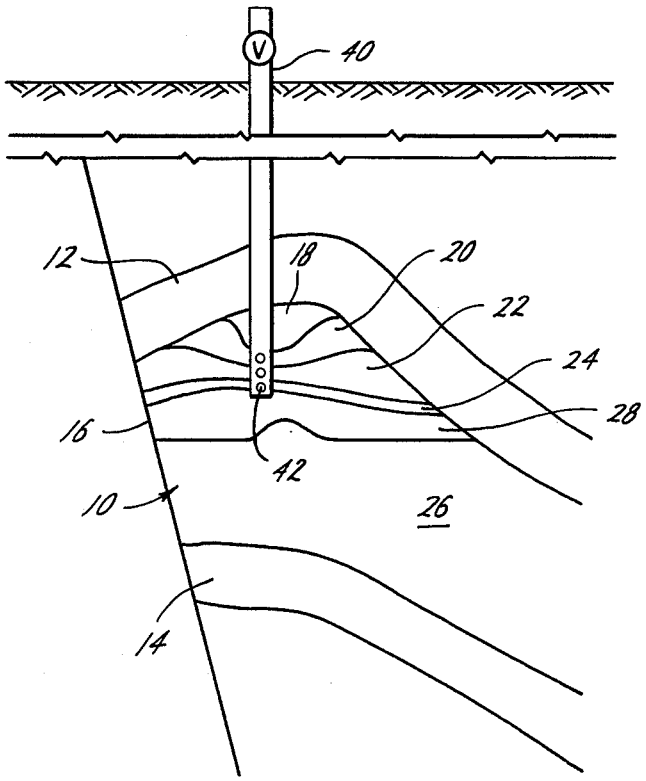
FIG. 9 is a cross-sectional view of the oil reservoir of FIGS. 7 and 8 showing the location of the various water, gas, and oil-bearing zones during the practice of the present invention.

Referring now to FIG. 9, the effects of the practice of the present invention are noted wherein very large flow removal rates are utilized by allowing the geo-pressured aquifer 10 to flow fluids, under natural pressure, through the well 40 at a high enough rate of production to reduce the aquifer pressure near the well 40 sufficiently to allow the gas in various forms to expand and become free gas and then mobile gas, which mobile gas then moves towards the point of lowest pressure, that is, the openings 42 of the well 40. In order to accomplish the desired results, the pressure reduction of the bottom hole pressure of the well 40 should be as great as possible, such as 25%, and is accomplished by allowing a high rate of production, perhaps as high as 50,000 barrels per day per well, although as indicated 25,000 barrels per day per well may be sufficient. Initially, the majority of well production from the high rate of flow will be water from zone 28 as noted from the initial profiles of the various zones in FIG. 8. However, as the pressure in the aquifer 10 is reduced, gas in the zones 20, 22, 24, and 28 becomes free gas and mobile gas at which time it either migrates to the well 40 and is produced through the perforations 42, or it migrates to and increases the gas volume in zone 18. The net effect of the high rate of production of fluids from the well 40 causes the water cone 50 to drop because of the fact that the greater volume of gas in zone 18 expands and moves towards the point of lowest pressure, that is, the openings 42 in the well 40. At this point, as best seen in FIG. 9, the openings 42 of the well 40 are again open to zones 18, 20 and 22, as well as zones 24 and 28, and therefore an increasing amount of oil and gas are produced along with water. Importantly, it is noted that the primary oil zone 22 has opened up again to the openings 42 in the well 40 for producing additional "bypassed" oil and of course the high concentration of gas in the zone 22 has become free gas and either moved to the perforations of the well or to zones 18 and 20 thereby allowing additional recovery of valuable hydrocarbons.

Figure 10:
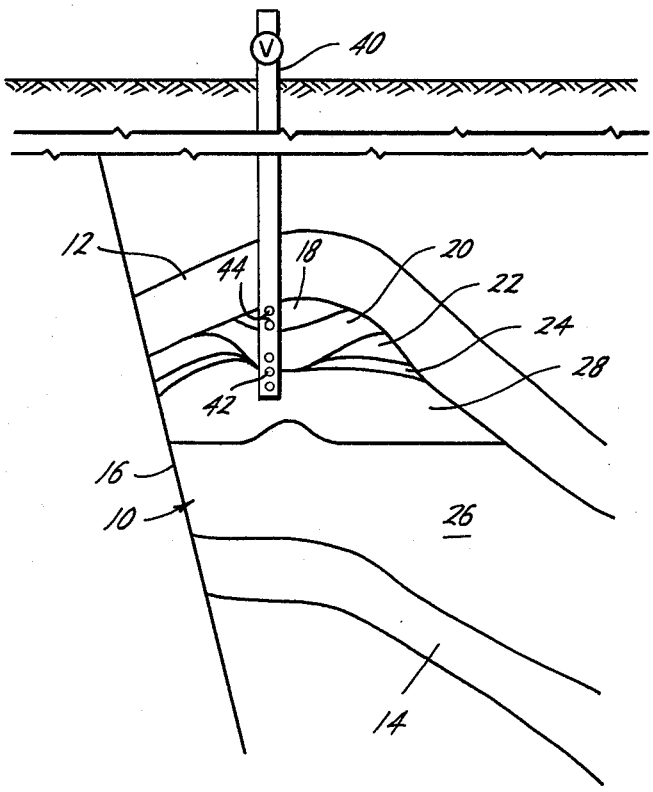
FIG. 10 is a cross-sectional view of the oil reservoir of FIGS. 7-9, subsequent to the practice of the present invention in FIG. 9.

Eventually, of course, even under the present method, the production of oil from zone 22 will cease, as best seen in FIG. 10, as the rising water in zone 28 and the downward movement of expanding gas in zones 18 and 20 will pinch off the oil zone 22. Thereafter, the well 40 may still continue to be economically feasible and producing gas and water and some oil from zones 18, 20 and 28. In fact, it may be desirable to provide additional openings 44 in the well 40 in zone 18 and above watered-out openings 42 to or even drill an additional well to zone 18 to produce the gas therein. Furthermore, if the flow of fluids from the well 40 reduces or essentially ceases, because of the lowering of pressure in the aquifer 10 with the consequent reduction in artesian flow rate from the well(s) 40, the present method also includes the step of further removing additional fluids from the well 40 in order to further lower the pressure in the aquifer 10 and release more gas from the fluids. One suitable method for removing additional fluids from well 40, even after the lowering of aquifer pressure, is by means of conventional gas lift using some of the gas produced and injecting the gas into the annulus between the casing and the tubing of well 40 and into the tubing to lift additional fluids through the well tubing. This will further lower the pressure in the aquifer 10 and release further gas for production.

The present invention greatly increases and maximizes the recovery of oil and natural gas from the aquifer 10 which was depleted by conventional oil production.

The present invention, therefore, is well adapted to carry out the objects and attain the ends and advantages mentioned as well as others inherent therein. While a presently preferred embodiment of the invention is given for the purpose of disclosure, numerous changes in the steps of the process depending upon aquifer conditions encountered will readily suggest themselves to those skilled in the art and which are encompassed within the spirit of the invention and the scope of the appended claims.

What is claimed is:

1. A method of increasing the recovery of oil and gas from a water-invaded geo-pressured water drive oil reservoir which has ceased producing oil by conventional production methods comprising, producing fluids including water, gas and oil from a well completed in the oil reservoir, by geo-pressure water drive, at a high enough rate of flow to reduce the bottom hole pressure of the well sufficiently to release gas from the oil and water whereby the gas will expand upon a lowered pressure and the water will recede from the well allowing an increased production of oil and gas.

2. The method of claim 1 wherein, the existing bottom hole pressure of the well is reduced by at least 25 percent.

3. The method of claim 1 including allowing the reservoir to initially flow fluids from the well at a rate of at least 25,000 barrels of fluid per day.

4. The method of claim 1 including, allowing the reservoir to intially flow fluids from the well at a rate of at least 25,000 barrels of fluid per day, and the existing bottom hole pressure of the well is reduced by at least 25 percent.

5. The method of claim 1 including, allowing gas released from solution with the oil and/or water but remote from the producing well to migrate to a structural high in the reservoir and producing said gas.

6. The method of claim 1 including, after fluid production from said well reduces or essentially ceases due to the lowering of the aquifer pressure, producing additional fluids from said well by injecting gas into said well and lifting fluids therethrough.

7. A method of increasing the recovery of gas from a water-invaded geo-pressured water drive oil reservoir which has ceased producing oil by conventional production methods comprising, producing fluids including water and gas from a well completed in the oil reservoir, by geo-pressure water drive, at a high rate of flow to reduce the bottom hole pressure of the well sufficiently to release gas from the oil and water whereby the gas will expand upon a lowered pressure and the water will recede from the well allowing the production of gas.

8. The method of claim 7 wherein, the existing bottom hole pressure of the well is reduced by at least 25 percent.

9. The method of claim 7 including allowing the reservoir to initially flow fluids from the well at a rate of at least 25,000 barrels of fluid per day.

10. The method of claim 7 including, allowing the reservoir to initially flow fluids from the well at a rate of at least 25,000 barrels of fluid per day, and the existing bottom hole pressure of the well is reduced by at least 25 percent.

11. The method of claim 7 including, allowing gas released from solution with the oil and/or water but remote from the producing well to migrate to a structural high in the reservoir and producing said gas.

12. The method of claim 7 including, after fluid production from said well reduces or essentially ceases due to the lowering of the aquifer pressure, producing additional fluids from said well by injecting gas into said well and lifting fluids therethrough.

* * * * *